US009922779B2

(12) United States Patent
Zhang et al.

(10) Patent No.: US 9,922,779 B2
(45) Date of Patent: Mar. 20, 2018

(54) ELECTRICAL ENCLOSURE, AND SWITCHING ASSEMBLY AND TRANSFER ASSEMBLY THEREFOR

(71) Applicant: EATON CORPORATION, Cleveland, OH (US)

(72) Inventors: Xuecheng Zhang, Xi'An (CN); Matthew Rain Darr, Edwardsville, IL (US); Xuan Guo, Xi'An (CN)

(73) Assignee: EATON CORPORATION, Cleveland, OH (US)

( * ) Notice: Subject to any disclaimer, the term of this patent is extended or adjusted under 35 U.S.C. 154(b) by 82 days.

(21) Appl. No.: 15/142,136

(22) Filed: Apr. 29, 2016

(65) Prior Publication Data

US 2017/0316892 A1 Nov. 2, 2017

(51) Int. Cl.
*H01H 3/12* (2006.01)
*H01H 9/02* (2006.01)

(52) U.S. Cl.
CPC ..... *H01H 3/12* (2013.01); *H01H 9/02* (2013.01)

(58) Field of Classification Search
CPC ..... H01H 3/12; H01H 9/02
USPC ..... 200/318–327, 330
See application file for complete search history.

(56) References Cited

U.S. PATENT DOCUMENTS 5,288,958 A * 2/1994 Grunert ..... H01H 9/22 200/329
5,493,084 A * 2/1996 Whitaker ..... H01H 3/10 200/330
6,194,983 B1 * 2/2001 Bogdon ..... G05G 1/04 200/329
7,348,510 B1 3/2008 Foley et al.
(Continued)

FOREIGN PATENT DOCUMENTS

DE 10 2009 053164 A1 5/2011
EP 2 843 676 A1 3/2015

OTHER PUBLICATIONS

Eaton Corporation, Compact Circuit Protector, Bussmann Series, Industry's Smallest Fused Disconnect Offers Superior Circuit Protection, Publication No. 3191, Oct. 2015, 4 pp.
(Continued)

*Primary Examiner* — Edwin A. Leon
*Assistant Examiner* — Iman Malakooti
(74) *Attorney, Agent, or Firm* — Eckert Seamans; John Powers; Grant Coffield

(57) ABSTRACT

A transfer assembly is for a switching assembly of an electrical enclosure. The switching assembly includes an electrical switching apparatus having an operating handle structured to move from an OFF position to an ON position. The transfer assembly includes a driving handle; a first shaft member coupled to the driving handle; a second shaft member structured to be coupled to the operating handle; and a transmission assembly having a first component and a
(Continued)

second component, the first component being coupled to the first shaft member, the second component being coupled to the second shaft member. The transfer assembly is structured to move from a FIRST position to a SECOND position. When the transfer assembly moves from the FIRST position to the SECOND position, the first component drives the second component, thereby causing the second shaft member to move the operating handle from the OFF position to the ON position.

19 Claims, 7 Drawing Sheets

(56) References Cited

U.S. PATENT DOCUMENTS

| | | | | |
|---|---|---|---|---|
| 7,473,116 | B2 | 1/2009 | Dudhwala et al. | |
| 7,482,548 | B2 * | 1/2009 | Periot | H01H 9/22 200/330 |
| 7,569,770 | B2 | 8/2009 | Remmert et al. | |
| 7,688,573 | B2 | 3/2010 | Ranta | |
| 8,319,123 | B2 | 11/2012 | Faulkner et al. | |
| 9,246,318 | B2 | 1/2016 | Hussey et al. | |
| 2002/0038759 | A1 | 4/2002 | Hamada et al. | |
| 2009/0057118 | A1 * | 3/2009 | Nguyen | G05G 1/10 200/330 |
| 2011/0163837 | A1 * | 7/2011 | Darr | H01H 1/20 337/186 |
| 2015/0155111 | A1 * | 6/2015 | Kondrus | H05K 5/0017 200/43.13 |

OTHER PUBLICATIONS

European Patent Office, "extended European search report", (corresp. to EP 17167168.8), dated Oct. 9, 2017, 7 pp.

* cited by examiner

ELECTRICAL ENCLOSURE, AND SWITCHING ASSEMBLY AND TRANSFER ASSEMBLY THEREFOR

BACKGROUND

Field

The disclosed concept relates generally to enclosures and, more specifically, to electrical enclosures. The disclosed concept further relates to switching assemblies for electrical enclosures including, for example, electrical switching apparatus. The disclosed concept also relates to transfer assemblies for switching assemblies.

Background Information

Electrical enclosures can enclose a wide range of electrical equipment, such as, for example and without limitation, electrical switching apparatus. Many known electrical enclosures do not provide a reliable mechanism to operate the electrical switching apparatus located within the electrical enclosure from a position outside of the electrical enclosure. For example, moving the electrical switching apparatus located within the electrical enclosure between ON and OFF positions typically requires a burdensome process of opening the electrical enclosure (e.g., a door member) in order to reach inside and access the electrical switching apparatus.

There is thus room for improvement in electrical enclosures, and in switching assemblies and transfer assemblies therefor.

SUMMARY

These needs and others are met by embodiments of the disclosed concept, which are directed to an electrical enclosure, and switching assembly and transfer assembly therefor.

As one aspect of the disclosed concept, a transfer assembly for a switching assembly of an electrical enclosure is provided. The switching assembly includes an electrical switching apparatus having an operating handle structured to move from an OFF position to an ON position. The transfer assembly comprises a driving handle; a first shaft member coupled to the driving handle; a second shaft member structured to be coupled to the operating handle; and a transmission assembly comprising a first component and a second component, the first component being coupled to the first shaft member, the second component being coupled to the second shaft member. The transfer assembly is structured to move from a FIRST position to a SECOND position. When the transfer assembly moves from the FIRST position to the SECOND position, the first component drives the second component, thereby causing the second shaft member to move the operating handle from the OFF position to the ON position.

As another aspect of the disclosed concept, a switching assembly including an electrical switching apparatus and the aforementioned transfer assembly is provided.

As another aspect of the disclosed concept, an electrical enclosure including a number of enclosure members and the aforementioned switching assembly is provided. The enclosure members are cooperatively structured to form an enclosed region. The electrical switching apparatus is located within the enclosed region and the driving handle is located external with respect to the enclosed region.

BRIEF DESCRIPTION OF THE DRAWINGS

A full understanding of the disclosed concept can be gained from the following description of the preferred embodiments when read in conjunction with the accompanying drawings in which.

DESCRIPTION OF THE PREFERRED EMBODIMENTS

As employed herein, the term "number" shall mean one or an integer greater than one (i.e., a plurality).

As employed herein, the statement that two or more parts are "connected" or "coupled" together shall mean that the parts are joined together either directly or joined through one or more intermediate parts.

As employed herein, the statement that two or more parts or components "engage" one another shall mean that the parts exert a force against one another either directly or through one or more intermediate parts or components.

As employed herein, the term "drives" shall mean that a first component causes a second component to move, either through direct engagement between the first component and the second component, or through indirect engagement wherein the first component and the second component do not directly engage one another, but a number of intermediate components provide a link between the first component and the second component in order to allow the first component to cause the second component to move.

As employed herein, the term "coupling member" refers to any suitable connecting or tightening mechanism expressly including, but not limited to, rivets, screws, bolts, the combination of bolts and nuts (e.g., without limitation, lock nuts), washers and nuts, zip ties, and wire ties.

Figure 1:
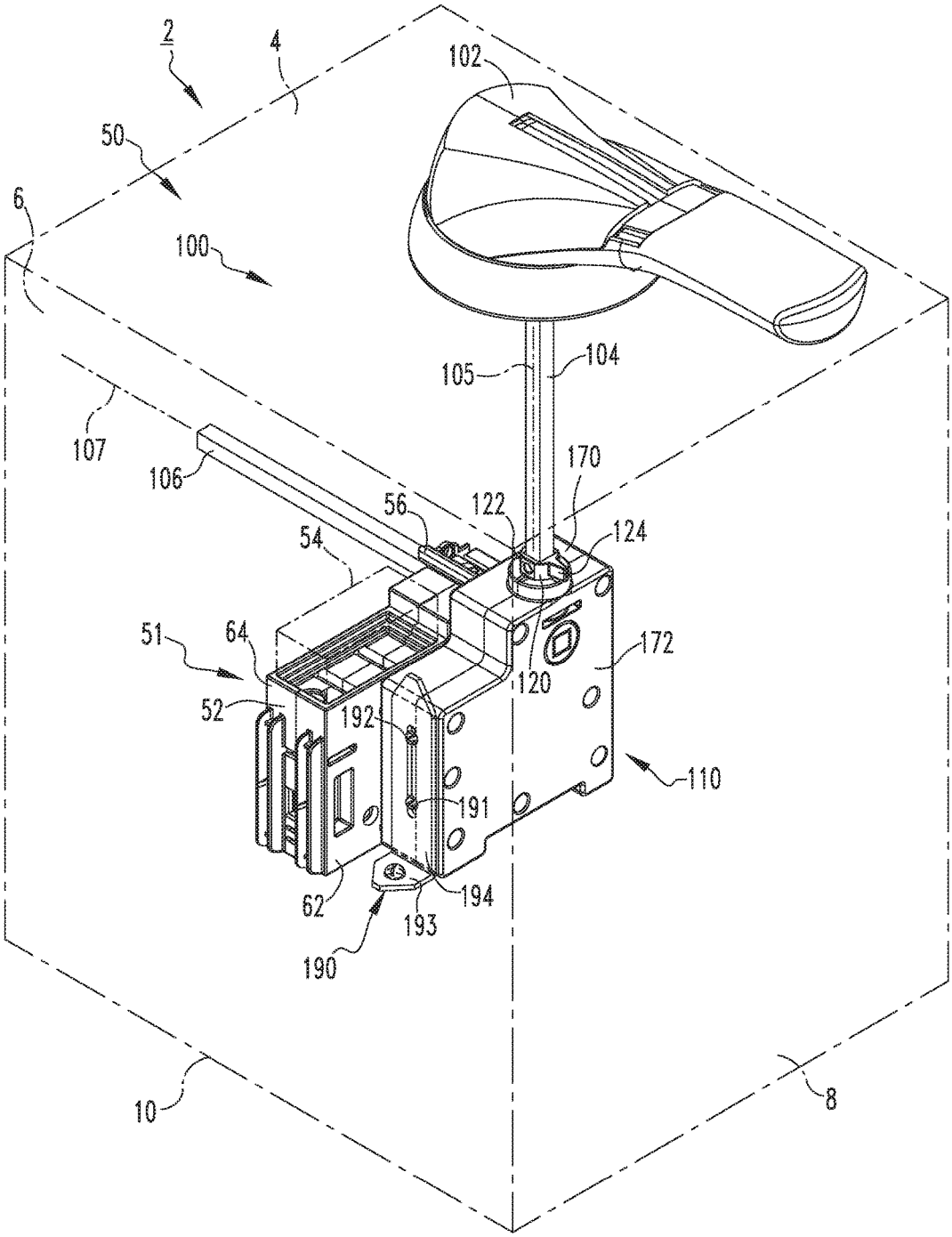
FIG. 1 is a simplified front isometric view of an electrical enclosure, and switching assembly and transfer assembly therefor, partially shown in simplified form in phantom line drawing, and shown with the transfer assembly in a FIRST position, in accordance with a non-limiting embodiment of the disclosed concept.

FIG. 1 shows an electrical enclosure 2 (partially shown in simplified form in phantom line drawing), in accordance with a non-limiting embodiment of the disclosed concept.

The example electrical enclosure 2 includes a number of enclosure members (e.g., without limitation, door 4 and panel members 6,8,10, all shown in simplified form) coupled to one another, and a switching assembly 50. The switching assembly 50 includes an electrical switching apparatus 51 and a transfer assembly 100. The door 4 and the panel members 6,8,10 together define an enclosed region to enclose the electrical switching apparatus 51. As will be discussed in greater detail hereinbelow, the transfer assembly 100 provides a novel mechanism to allow the electrical switching apparatus 51 to move between an ON position and an OFF position without having to separately open the door 4 or otherwise access the interior of the electrical enclosure 2. That is, operators can operate the transfer assembly 100 to move the electrical switching apparatus 51 between the ON and OFF positions from outside of the electrical enclosure 2. This saves time, as operators might otherwise be required to open a door (not shown) in order to move a similarly enclosed electrical switching apparatus (not shown) between ON and OFF positions. Additionally, the transfer assembly 100 improves safety in that operators can open a respective electrical circuit before opening the electrical enclosure 2 to access the interior.

The electrical switching apparatus 51 includes a compact circuit protector 52 and a fuse 54 (shown in simplified form in phantom line drawing in FIG. 1) mechanically coupled and electrically connected to the compact circuit protector 52. The compact circuit protector 52 has an operating handle 56, which is depicted in an OFF position in FIG. 1 and an ON position in FIG. 2. In order to cause the operating handle 56 to move between the ON and OFF positions (i.e., in order to close and open the electrical circuit), and responsive to activation by an operator, the transfer assembly 100 is structured to move between a FIRST position and a SECOND position.

The transfer assembly 100 includes a driving handle 102, a number of shaft members 104,106, and a transmission assembly 110. The shaft members 104,106 and the transmission assembly 110 transmit rotary motion of the driving handle 102 (i.e., as a result of an operator manually moving the driving handle 102) into movement of the electrical switching apparatus operating handle 56. The first shaft member 104 extends through the door 4 and is coupled to the driving handle 102 such that the door 4 is located between the driving handle 102 and the transmission assembly 110. Referring to the partially exploded view of FIG. 3, the compact circuit protector 52 includes a number of wall members 62,64 structured to be coupled to the operating handle 56, and the operating handle 56 includes a receiving portion 58 and a distal portion 60 opposite the receiving portion 58. In one exemplary embodiment, the second shaft member 106 at least partially extends into the receiving portion 58 and through the wall members 62,64. Furthermore, the receiving portion 58 is shaped corresponding to the cross-section of the second shaft member 106 (e.g., without limitation, rectangular-shaped) and is coupled to the second shaft member 106 in order that rotation of the second shaft member 106 corresponds to rotation of the operating handle 56. Stated differently, rotation of the second shaft member 106 causes the operating handle 56 to rotate.

Figure 2:
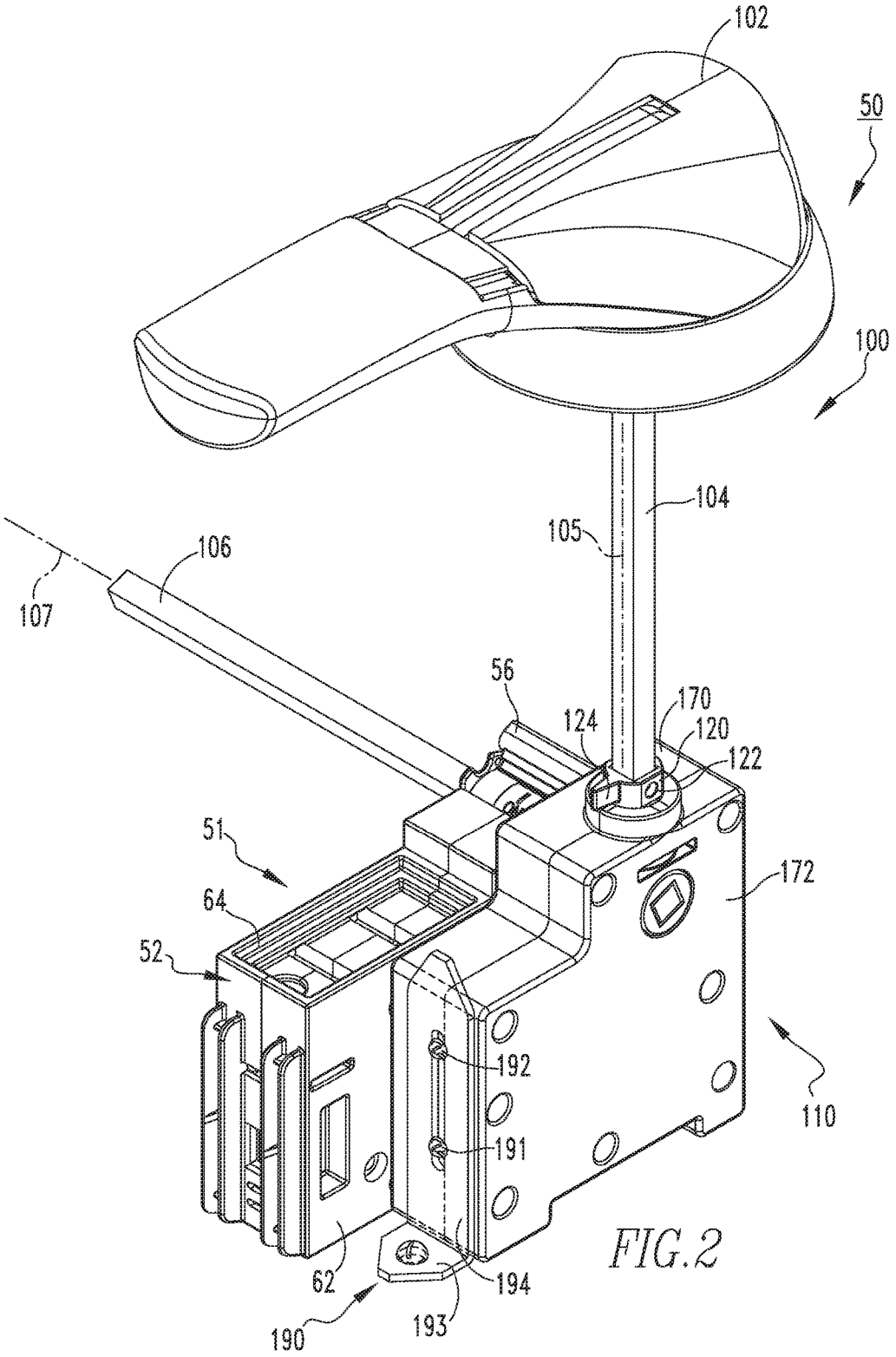
FIG. 2 is a front isometric view of the switching assembly and transfer assembly therefor of FIG. 1, shown with the transfer assembly in a SECOND position.
Figure 3:
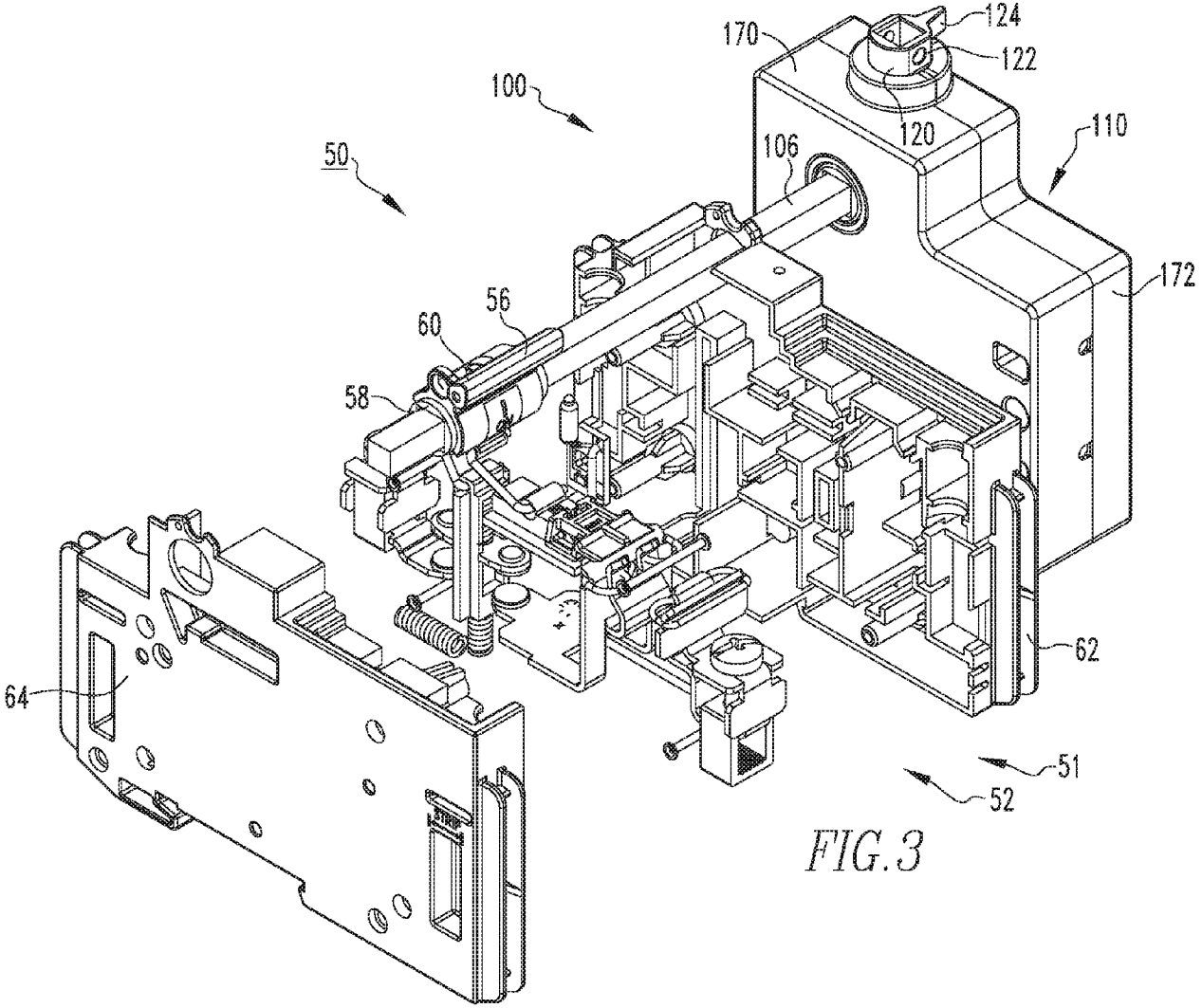
FIG. 3 is a partially exploded front isometric view of a portion of the switching assembly and transfer assembly therefor of FIG. 2, shown with the transfer assembly in the FIRST position.
Figure 4:
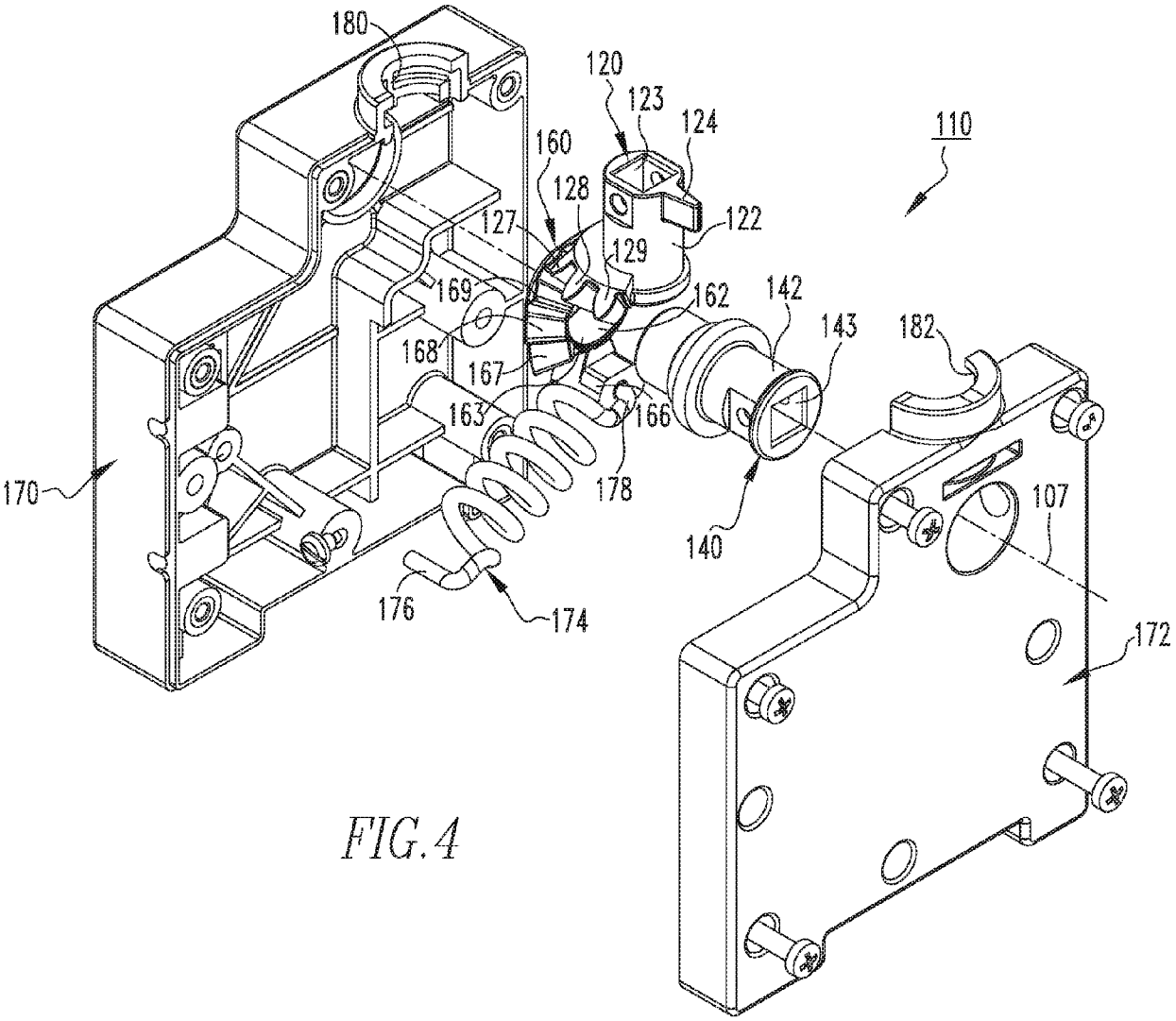
FIG. 4 is an exploded front isometric view of the transmission assembly for the transfer assembly of FIG. 3.

FIG. 4 shows an exploded view of the transmission assembly 110. As shown, the transmission assembly 110 is structured to operate as a gear box that transmits rotation of the first shaft member 104 (FIGS. 1 and 2) into rotation of the second shaft member 106 (FIGS. 1 through 3). More specifically, the transmission assembly 110 includes a number of gears (e.g., without limitation, bevel gears 120,160), another component 140, a number of housing members 170,172 coupled to one another, and a biasing element (e.g., without limitation, compression spring 174). It will be appreciated that the second shaft member 106 extends through the housing member 170.

The first bevel gear 120 has a body 122, a first protrusion 124 and a second, partially annular-shaped protrusion 126 (shown in FIGS. 5A through 7B) each extending outwardly from the body 122. The body 122 has a rectangular-shaped receiving portion 123. The first shaft member 104 extends into the receiving portion 123 and is coupled to the body 122. In this manner, rotation of the first shaft member 104 causes rotation of the first bevel gear 120. The housing members 170,172 each have respective semi-annular shaped grooved regions 180,182. Thus, when the housing members 170,172 are assembled and are adjacent one another, the semi-annular shaped grooved regions 180,182 together define a smooth annular-shaped grooved region. In operation, when the first shaft member 104 is rotated responsive to rotation of the driving handle 102, the second protrusion 126 rotates within the grooved regions 180,182 (see, for example, FIGS. 5A, 6A, and 7A). This motion advantageously fixes the longitudinal position of the first shaft member 104 with respect to the housing members 170,172. In other words, the first shaft member 104 may rotate with respect to portions of the transmission assembly (i.e., the housing members 170,172), but the second protrusion 126 and the grooved regions 180,182 limit the length with which the first shaft member 104 can extend into the transmission assembly 110.

Additionally, referring again to FIGS. 1 through 3, the first protrusion 124 is located external with respect to the housing members 170,172 and is structured to provide an indication of whether the electrical switching apparatus 51 is in the ON or OFF position. For example and without limitation, as shown in FIG. 1, when the electrical switching apparatus 51 is in the OFF position, the first protrusion 124 extends from the body 122 away from the electrical switching apparatus 51 (i.e., in a direction perpendicular to the electrical switching apparatus 51). When the transmission assembly 110 has been moved to the SECOND position, shown in FIG. 2, the first protrusion 124 extends from the body 122 in a direction parallel with the electrical switching apparatus 51. As such, the first protrusion 124 provides a beneficial mechanism to indicate which positions of the transfer assembly 100 correspond to the ON and OFF positions of the electrical switching apparatus 51. This helps with alignment of the transfer assembly 110 during assembly of the electrical enclosure 2.

Referring again to FIG. 4, the second bevel gear 160 includes a body 162, a first protrusion 164 (shown in FIGS. 5A through 7B) and a second protrusion 166 each extending outwardly from the body 162. The body 162 has a number of teeth (three teeth 167,168,169 are indicated), and the body 122 of the bevel gear 120 has a number of teeth (three teeth 127,128,129 are indicated). The teeth 127,128,129,167,168,169 are each located internal with respect to the housing members 170,172. The teeth 127,128,129 mechanically engage and cooperate with the teeth 167,168,169. That is, rotation of the first bevel gear 120 (i.e., responsive to rotation of the first shaft member 104 about a longitudinal axis 105 (FIGS. 1 and 2) of the first shaft member 104) is structured to cause the second bevel gear 160 to rotate about a longitudinal axis (see longitudinal axis 107 in FIGS. 1 and 2, which extends through a central thru hole of the second bevel gear 160) of the second shaft member 106. In turn, the rotation of the second bevel gear 160 is structured to cause the second shaft member 106, by way of the component 140, to rotate about the longitudinal axis 107. It will thus be understood that when the transfer assembly 100 moves from the FIRST position to the SECOND position, the first bevel gear 120 drives the component 140, thereby causing the second shaft member 106 to move the operating handle 56 between the ON position and the OFF position.

More specifically, the component 140 includes a body 142 and a projection 144 (shown in FIGS. 5A through 7B) extending outwardly from the body 142. The body 142 has a rectangular-shaped receiving portion 143 that receives the second shaft member 106 in order to couple the second shaft member 106 to the body 142 to transmit rotation of the second bevel gear 160 into rotation of the second shaft member 106. As such, the body 142 extends into and through at least a portion of the body 162.

Figure 5A:
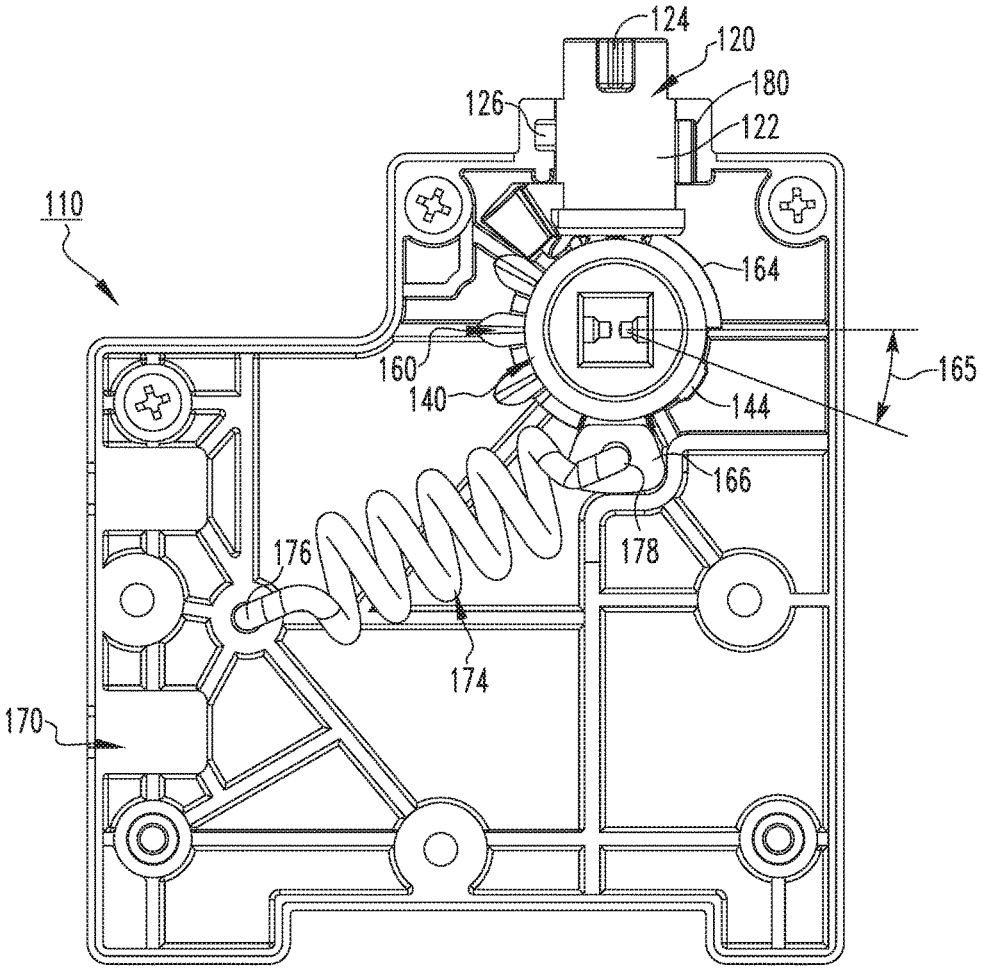
FIG. 5A is a front elevation view of a portion of the transmission assembly of FIG. 4, shown with the transmission assembly in the FIRST position.
Figure 5B:
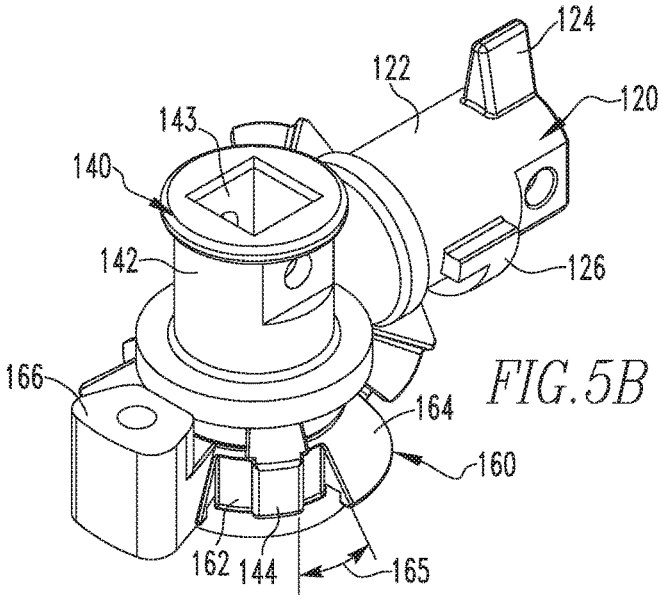
FIG. 5B is a front isometric view of a number of components of the transmission assembly of FIG. 5A.
Figure 6A:
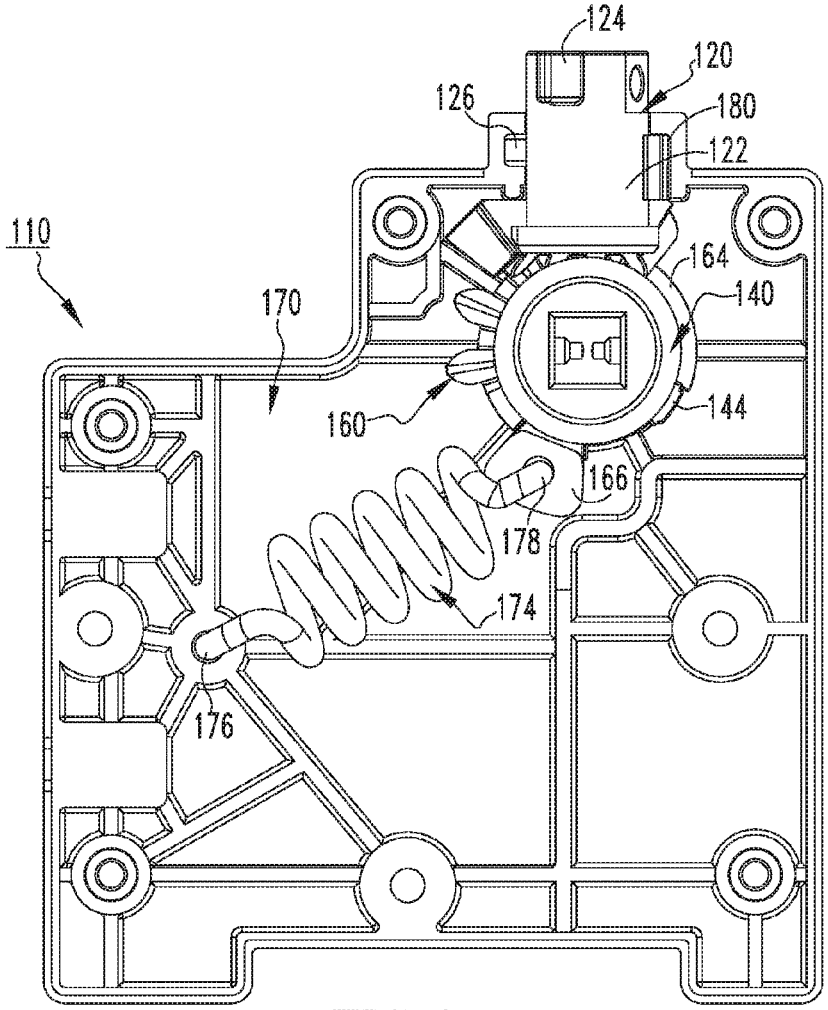
FIG. 6A is a front elevation view of the portion of the transmission assembly of FIG. 5A, shown with the transmission assembly in a THIRD position.
Figure 6B:
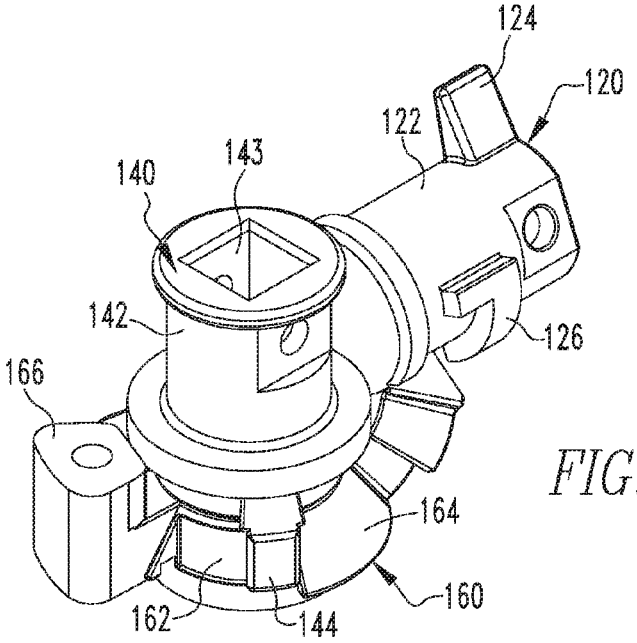
FIG. 6B is a front isometric view of a number of components of the transmission assembly of FIG. 6A.
Figure 7A:
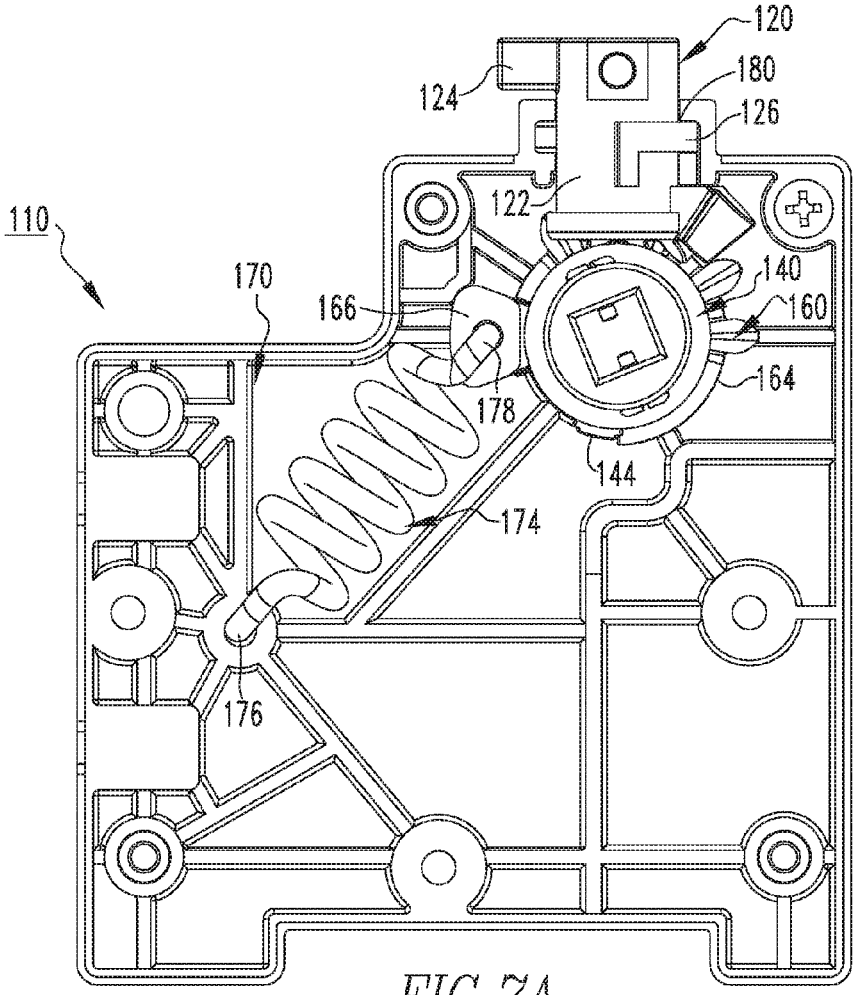
FIG. 7A is a front elevation view of the portion of the transmission assembly of FIG. 6A, shown with the transmission assembly in the SECOND position.
Figure 7B:
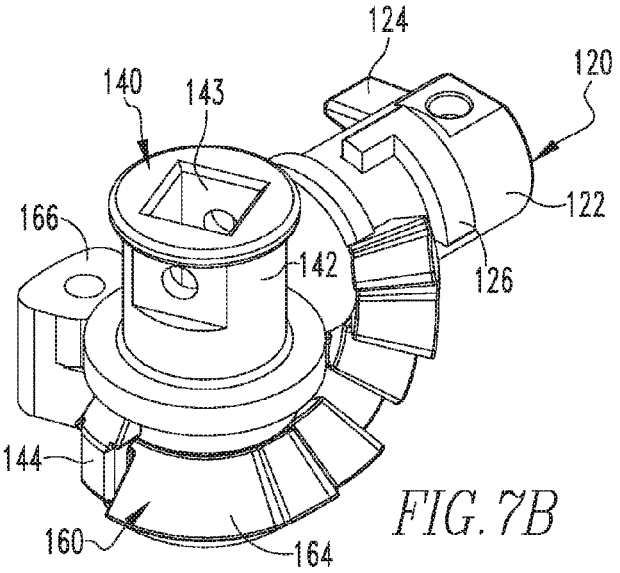
FIG. 7B is a front isometric view of a number of components of the transmission assembly of FIG. 7A.

As shown in FIGS. 5A and 5B, when the bevel gears 120,160 and the component 140 are in the FIRST position (i.e., when the transfer assembly 100 is in the FIRST position), the first protrusion 164 of the second bevel gear 160 is spaced from the projection 144 of the component 140. When the second bevel gear 160 initially moves from the FIRST position (FIGS. 1, 3, 4, 5A, and 5B) toward the SECOND position (FIGS. 2, 7A, and 7B) responsive to rotation of the first bevel gear 120, the first protrusion 164 rotates toward the projection 144. Continued rotation of the second bevel gear 160 results in the protrusion 164 moving into engagement with the projection 144. This is depicted in FIG. 6A, which shows the transfer assembly 110 in a THIRD position between the FIRST position and the SECOND position. When the transfer assembly is moving from the FIRST position toward the THIRD position, the second bevel gear 160 rotates independently with respect to the component 140, and as such, is not causing the second shaft member 106 to rotate. It will be appreciated that when the transfer assembly 110 moves from the FIRST position to the THIRD position, the first protrusion 164 rotates an angle (see, for example, angle 165 from the perspective of FIG. 5A) between 10 degrees and 40 degrees with respect to (i.e., rotates around) the longitudinal axis 107 (FIGS. 1, 2, and 4) in order to move into engagement with the projection 144. When the transfer assembly 100 moves from the THIRD (FIGS. 6A and 6B) position toward the SECOND position (FIGS. 7A and 7B), the first protrusion 164 drives (i.e., engages and thereby rotates together with) the projection 144, thereby causing the second shaft member 106, which is fixed with respect to the component 140, to rotate.

Accordingly, it will be appreciated that the novel mechanism of the disclosed concept advantageously allows the transfer assembly 100 to be employed with a large number of different electrical switching apparatus (not shown) in addition to the electrical switching apparatus 51. More specifically, the compact circuit protector 52 has a predetermined range of rotation over which the operating handle 56 rotates. If the transfer assembly 100 is employed with a suitable alternative electrical switching apparatus (not shown), the range of rotation may be different. As such, in order to ensure that the operating handle (not shown) of such an electrical switching apparatus (not shown) reliably moves between ON and OFF positions, the angle 165 is advantageously able to be changed to correspond to the different angle of rotation.

In order to reliably move the transfer assembly 100 between the FIRST position and the SECOND position, and also to maintain the transfer assembly 100 in the FIRST position and the SECOND position, as desired, the transmission assembly 110 preferably further includes the compression spring 174. Specifically, referring to FIGS. 5A and 7A, the compression spring 174 has a first end portion 176 coupled to and fixed with respect to the housing member 170, and a second, opposing end portion 178 coupled to the second protrusion 166 of the second bevel gear 160. When the transfer assembly 100 moves between the FIRST position and the SECOND position, the second end portion 178 rotates about the longitudinal 107 (FIGS. 1 and 2) in order to function as an operating mechanism for the transmission assembly 110. Specifically, when the transfer assembly 100 is in the FIRST position, the compression spring 174 biases the transfer assembly 100 to the FIRST position. When the transfer assembly 100 moves from the FIRST position to the SECOND position, the compression spring 174 passes its equilibrium position (i.e., the position in which the compression spring does not bias the transfer assembly 110 toward either the FIRST position or the SECOND position). As the compression spring 174 passes its equilibrium position, the compression spring begins to release stored energy and to bias the transfer assembly 100 toward the SECOND position. Thus, when the transfer assembly 100 is in the SECOND position, the compression spring 174 biases the transfer assembly 100 to the SECOND position.

Referring again to FIG. 1, in order to mount the transfer assembly 100 within the electrical enclosure 2, the transmission assembly 110 further includes a mounting member 190 and a number of coupling members 191,192 that couple the mounting member 190 to the housing members 170,172. In the example shown and described herein, the mounting member 190 has a pair of planar portions 193,194 extending from and being perpendicular to one another. The first planar portion 193 is flush with and coupled to the panel member 10. The second planar portion 194 has an elongated slot and the coupling members 191,192 extend through the slot and into at least one of the housing members 170,172 in order to couple the housing members 170,172 to the mounting member 190 (i.e., and thus the panel member 10). As a result, the height of the transfer assembly 100 is advantageously able to be adjusted as a result of the slot in the mounting member 190.

Accordingly, it will be appreciated that the disclosed concept provides for an improved (e.g., without limitation, more efficient and safer) electrical enclosure 2, and switching assembly 50 and transfer assembly 100 therefor, in which operating personnel can move an electrical switching apparatus 51 between ON and OFF positions from a location external to the electrical enclosure 2. In other words, the electrical switching apparatus 51, which is located in an enclosed region defined by a door 4 and a number of panel members 6,8,10, can be operated and/or moved between ON and OFF positions from a position external the enclosed region by, for example, simple rotation of a driving handle 102 of the transfer assembly 100. Thus, among other advantages, the disclosed concept saves operators time, and provides safety and protection, as compared to prior art electrical enclosures.

While specific embodiments of the disclosed concept have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the disclosed concept which is to be given the full breadth of the claims appended and any and all equivalents thereof.

What is claimed is:

1. A transfer assembly for a switching assembly of an electrical enclosure, said switching assembly comprising an electrical switching apparatus having an operating handle structured to move from an OFF position to an ON position, said transfer assembly comprising:

a driving handle;

a first shaft member coupled to said driving handle;

a second shaft member structured to be coupled to said operating handle; and a transmission assembly comprising a first component and a second component, said first component being coupled to said first shaft member, said second component being coupled to said second shaft member, wherein said transfer assembly is structured to move from a FIRST position to a SECOND position, and wherein, when said transfer assembly moves from the FIRST position to the SECOND position, said first component drives said second component, thereby causing said second shaft member to move said operating handle from the OFF position to the ON position; wherein said first component is a first gear member; and wherein said transmission assembly further comprises a second gear member engaging said first gear member and said second component.

2. The transfer assembly of claim 1 wherein said transfer assembly has a THIRD position between the FIRST position and the SECOND position; wherein, when said transfer assembly moves from the FIRST position to the THIRD position, said second gear member rotates independently with respect to said second component; and wherein, when said transfer assembly moves from the THIRD position to the SECOND position, said second gear member and said second component rotate together.

3. The transfer assembly of claim 2 wherein said second component comprises a body and a projection extending outwardly from said body of said second component; wherein said second shaft member at least partially extends into said body of said second component; wherein said second shaft member has a longitudinal axis; wherein said second gear member comprises a body and a protrusion extending outwardly from said body of said second gear member; wherein, when said transfer assembly is in the FIRST position, said protrusion is spaced from said projection; and wherein, when said transfer assembly moves from the FIRST position to the THIRD position, said protrusion rotates between 10 degrees and 40 degrees with respect to the longitudinal axis in order to move into engagement with said projection.

4. The transfer assembly of claim 1 wherein said transmission assembly further comprises a housing member and a biasing element; wherein said biasing element is coupled to said housing member and said second gear member; wherein, when said transfer assembly is in the FIRST position, said biasing element biases said transfer assembly to the FIRST position; and wherein, when said transfer assembly is in the SECOND position, said biasing element biases said transfer assembly to the SECOND position.

5. The transfer assembly of claim 4 wherein said second shaft member has a longitudinal axis; wherein said biasing element is a compression spring comprising a first end portion and a second end portion disposed opposite said first end portion; wherein said first end portion is coupled to and is fixed with respect to said housing member; and wherein, when said transfer assembly moves from the FIRST position to the SECOND position, said second end portion rotates about the longitudinal axis.

6. The transfer assembly of claim 1 wherein said transmission assembly further comprises a first housing member and a second housing member coupled to said first housing member; wherein said second shaft member extends through said first housing member; wherein said first housing member has a grooved region; wherein said second housing member has a grooved region disposed adjacent said grooved region of said first housing member; wherein said first gear member comprises a body and a protrusion extending outwardly from said body; and wherein said protrusion is structured to rotate within said grooved region of said first housing member and said grooved region of said second housing member.

7. The transfer assembly of claim 1 wherein said transmission assembly further comprises a first housing member and a second housing member coupled to said first housing member; wherein said second shaft member extends through said first housing member; wherein said first gear member comprises a body and a protrusion extending outwardly from said body; wherein said body has a number of teeth disposed internal with respect to said first housing member and said second housing member; and wherein said protrusion is disposed external with respect to said first housing member and said second housing member.

8. The transfer assembly of claim 1 wherein said first gear member is a first bevel gear member; wherein said second gear member is a second bevel gear member having a thru hole; wherein said second component extends at least partially into the thru hole; and wherein said second shaft member has a longitudinal axis extending through the thru hole.

9. The transfer assembly of claim 1 wherein said transmission assembly further comprises a first housing member, a second housing member coupled to said first housing member, a mounting member, and a number of coupling members; wherein said second shaft member extends through said first housing member; wherein said mounting member has an elongated slot; and wherein said number of coupling members extend through said slot and into one of said first housing member and said second housing member in order to couple said mounting member to said first housing member and said second housing member.

10. A switching assembly of an electrical enclosure, said switching assembly comprising:

an electrical switching apparatus having an operating handle structured to move from an OFF position to an ON position; and a transfer assembly comprising:

a driving handle, a first shaft member coupled to said driving handle, a second shaft member coupled to said operating handle, and a transmission assembly comprising a first component and a second component, said first component being coupled to said first shaft member, said second component being coupled to said second shaft member, wherein said transfer assembly is structured to move from a FIRST position to a SECOND position, wherein, when said transfer assembly moves from the FIRST position to the SECOND position, said first component drives said second component, thereby causing said second shaft member to move said operating handle from the OFF position to the ON position; wherein said first component is a first gear member; and wherein said transmission assembly further comprises a second gear member engaging said first gear member and said second component.

11. The switching assembly of claim 10 wherein said operating handle comprises a receiving portion and a distal portion disposed opposite said receiving portion; and wherein said second shaft member extends at least partially into said receiving portion.

12. The switching assembly of claim 11 wherein said second shaft member has a rectangular-shaped cross section; and wherein said receiving portion is shaped corresponding to the rectangular-shaped cross section of said second shaft member.

13. The switching assembly of claim 10 wherein said electrical switching apparatus comprises a compact circuit protector and a fuse electrically connected to said compact circuit protector; wherein said compact circuit protector comprises a wall member; and wherein said second shaft member extends through said wall member.

14. An electrical enclosure comprising:

a number of enclosure members cooperatively structured to form an enclosed region; and a switching assembly comprising:

an electrical switching apparatus disposed within the enclosed region, said electrical switching apparatus having an operating handle structured to move from an OFF position to an ON position, and a transfer assembly comprising:

a driving handle disposed external with respect to the enclosed region, a first shaft member coupled to said driving handle, a second shaft member coupled to said operating handle, and a transmission assembly comprising a first component and a second component, said first component being coupled to said first shaft member, said second component being coupled to said second shaft member, wherein said transfer assembly is structured to move from a FIRST position to a SECOND position, wherein, when said transfer assembly moves from the FIRST position to the SECOND position, said first component drives said second component, thereby causing said second shaft member to move said operating handle from the OFF position to the ON position; wherein said first component is a first gear member; and wherein said transmission assembly further comprises a second gear member engaging said first gear member and said second component.

15. The electrical enclosure of claim 14 wherein said number of enclosure members comprises a door member; wherein said first shaft member extends through said door member; and wherein said door member is disposed between said driving handle and said transmission assembly.

16. The electrical enclosure of claim 14 wherein said number of enclosure members comprises a panel member; wherein said transmission assembly further comprises a first housing member, a second housing member coupled to said first housing member, a mounting member coupled to said panel member, and a number of coupling members; wherein said second shaft member extends through said first housing member; wherein said mounting member has an elongated slot; and wherein said number of coupling members extend through said slot and into one of said first housing member and said second housing member in order to couple said mounting member to said first housing member and said second housing member.

17. The electrical enclosure of claim 16 wherein said mounting member comprises a first planar portion and a second planar portion extending from and being disposed perpendicular to said first planar portion; and wherein said first planar portion is flush with and coupled to said panel member.

18. The electrical enclosure of claim 14 wherein said transfer assembly has a THIRD position between the FIRST position and the SECOND position; wherein, when said transfer assembly moves from the FIRST position to the THIRD position, said second gear member rotates independently with respect to said second component; and wherein, when said transfer assembly moves from the THIRD position to the SECOND position, said second gear member and said second component rotate together.

19. The electrical enclosure of claim 18 wherein said second component comprises a body and a projection extending outwardly from said body of said second component; wherein said second shaft member at least partially extends into said body of said second component; wherein said second shaft member has a longitudinal axis; wherein said second gear member comprises a body and a protrusion extending outwardly from said body of said second gear member; wherein, when said transfer assembly is in the FIRST position, said protrusion is spaced from said projection; and wherein, when said transfer assembly moves from the FIRST position to the THIRD position, said protrusion rotates between 10 degrees and 40 degrees with respect to the longitudinal axis in order to move into engagement with said projection.

* * * * *